United States Patent [19]

Scelba et al.

[11] 4,343,163

[45] Aug. 10, 1982

[54] COMBINATION LOCK WITH SCRAMBLE FEATURE

[75] Inventors: Stephen S. Scelba, Clifton; Lazlo Bako, Woodcliff Lake, both of N.J.

[73] Assignee: Presto Lock, Inc., Garfield, N.J.

[21] Appl. No.: 160,420

[22] Filed: Jun. 18, 1980

[51] Int. Cl.[3] ..... E05B 37/02

[52] U.S. Cl. ..... 70/312; 70/71

[58] Field of Search ..... 70/67–76, 70/312, 315–318

[56] References Cited

U.S. PATENT DOCUMENTS

| | | | |
|---|---|---|---|
| 2,136,493 | 11/1938 | Denerich . | |
| 2,144,047 | 1/1939 | Eden . | |
| 2,163,852 | 6/1939 | Pond . | |
| 3,736,778 | 6/1973 | Bako | 70/70 |
| 4,048,821 | 9/1977 | Bako et al. | 70/25 |
| 4,123,923 | 11/1978 | Bako | 70/74 |
| 4,155,234 | 5/1979 | Bako | 70/312 |
| 4,259,856 | 4/1981 | Wingert | 70/70 |

*Primary Examiner*—Robert L. Wolfe

*Attorney, Agent, or Firm*—Shapiro and Shapiro

[57] ABSTRACT

A combination lock of the dial and sleeve type has a scramble feature enabling a hasp to be engaged with a latch of the lock even when the dials and sleeves are not on-combination, by independent movement of the latch relative to manual actuating means of the lock. When the hasp is engaged, it supports the latch in a position in which the latch is adapted to engage a blocking element that prevents the latch from being moved out of its hasp-engaging position independently of the manual actuator. This arrangement effectively prevents the lock from being forced open when the hasp is engaged.

24 Claims, 14 Drawing Figures

COMBINATION LOCK WITH SCRAMBLE FEATURE

BACKGROUND OF THE INVENTION

This invention relates to combination locks of the type having a hasp-engaging latch, which is moved from a hasp-engaging position by means of a movable actuator in order to release the hasp and open the lock. Such locks employ combination locking means, such as combination tumblers, dials or the like, associated with the actuator to prevent the actuator from moving the latch out of engagement with the hasp except when the combination locking means is on-combination.

In locks of the above type, the latch may be spring biased to return to its hasp-engaging position when the hasp is released. Accordingly, in locks where the latch and actuator are rigidly connected, in order to re-engage the hasp with the latch, it is necessary for the lock to be on-combination so that the latch and actuator can be moved by the hasp against the spring bias as the hasp is pressed into position.

It is an advantage, for security reasons, to provide a facility whereby the combination locking means can be scrambled to an off-combination setting when the hasp is disengaged and whereby the hasp can be re-engaged while the lock is still off-combination. To this end, it has previously been proposed to provide a connection between the latch and actuator which allows the latch to be moved away from its hasp-engaging position independently of the actuator, through pressure exerted by the hasp when it is pressed into place, the latch being spring biased to snap into its hasp-engaging position when the hasp is pressed fully home. The connection between the latch and actuator is still such as to allow withdrawal of the latch from engagement with the hasp in the conventional manner by movement of the actuator, only when the lock is on-combination.

With locks having the above-described scrambling facility, however, since the latch is not itself positively locked when the hasp is engaged, it may be possible to open the lock even when it is off-combination, by manipulating a small tool or suitably bent wire under the hasp plate and thereby moving the latch out of hasp engagement, or by striking a blow against the lock in a suitable direction to move the latch. The present invention seeks at least to minimize and preferably to avoid this possibility.

It is a principal object of the invention to provide a combination lock of the character described, which has a facility whereby the hasp can be engaged with the latch even when the lock is off-combination, by movement of the latch independently of the actuator, but wherein the latch effectively cannot be forced out of engagement with the hasp independently of the actuator when the hasp is engaged.

Another object of the invention is to provide a novel form of combination lock employing combination dials and sleeves for controlling movement of an actuator, a hasp-engaging latch connected to the actuator for movement therewith to open the lock when the sleeves and dials are on-combination and wherein the latch can be moved away from a hasp-engaging position independently of the actuator only when the hasp is disengaged.

Yet another object of the invention is to provide a dial and sleeve type combination lock, for example of the character disclosed in U.S. Pat. No. 4,123,923 to Bako, issued Nov. 7, 1978 and commonly assigned herewith, with the facility whereby the hasp can be engaged with the latch even if the dials are off-combination but in which the latch effectively cannot be forced out of engagement with the hasp when the hasp is engaged.

SUMMARY OF THE INVENTION

The invention provides a combination lock of the character referred to, including a connection between the actuator and the latch which allows movement of the latch out of its hasp-engaging position independently of the actuator, when the hasp is disengaged, so that the hasp can be reinserted even when the lock is off-combination, but, in accordance with the invention, the lock further includes a blocking means which cooperates with the latch member when the hasp is engaged to prevent the latch member moving out of hasp engagement independently of the actuator in this condition of the lock.

Effectively, at least in a preferred form of the invention, the hasp when it is engaged, supports the latch in alignment with the blocking means to prevent the latch from being moved out of hasp-engagement independently of the actuator. When the hasp is disengaged, however, the latch can be brought out of alignment with the blocking means and moved independently of the actuator.

The invention finds particular application in a dial and sleeve type lock in which the actuator includes an axially movable shaft upon which the combination dials and sleeves are mounted. In this arrangement, the latch preferably has rearwardly extending limbs connected to the shaft through a bracket assembly allowing tilting of the latch relative to the shaft for moving the latch out of alignment with the blocking means. Conveniently, the blocking means is formed as a protrusion on a front portion of the shaft and when the hasp is engaged, it supports the latch for abutting engagement against this protrusion. When the hasp is disengaged, the latch can be brought out of this position to allow longitudinal movement thereof independently of the shaft.

The lock preferably also includes a shift mechanism, operable when the hasp is disengaged, for changing the combination of the lock by axially moving the sleeves out of coupling engagement with their respective dials.

BRIEF DESCRIPTION OF THE DRAWINGS

A preferred embodiment of the invention is described with reference to the accompanying drawings.

DESCRIPTION OF PREFERRED EMBODIMENT

Figure 1:
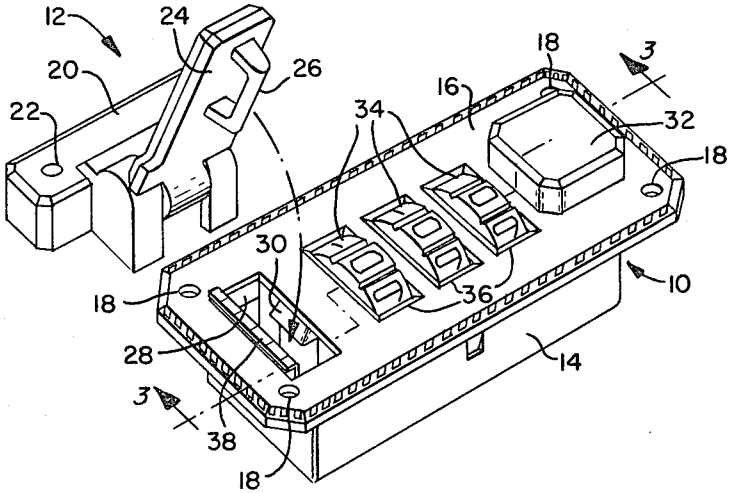
FIG. 1 is a perspective view of a combination lock in accordance with the invention shown with a cooperating hasp assembly.

Referring initially to FIG. 1, there is shown a combination lock, generally indicated by reference numeral 10, and a cooperating hasp assembly 12. It will be understood that the lock may, for example, be accommodated in a suitable opening formed in one section of a receptacle such as a luggage article, with the hasp assembly being attached to another section of the article to which the first section is to be releasably secured. The lock includes a generally rectangular casing 14 having a top plate 16 with openings 18 whereby the lock may be attached to the luggage article or the like by suitable screws, rivets, etc. The hasp assembly includes a mounting bracket 20 with openings 22 for attaching the assembly to the luggage or like article, and a hasp plate 24 having a conventional U-shaped hasp, pivotally mounted on bracket 20, the hasp plate being spring urged to the position shown in FIG. 1, in known manner. Hasp 26 is adapted to be inserted into lock 10 through an opening 28 in top plate 16 for engagement of the hasp with a latch 30 to releasably couple the lock and hasp assembly together. In order to move the latch 30 out of engagement with hasp 26, to open the lock, a manual latch actuator including a puller 32 is provided. The manual actuator is associated with a plurality of combination locking devices including combination dials 34 which project partially through openings 36 in top plate 16, the arrangement being such that puller 32 can only be operated to move latch 30 out of hasp engagement when the locking devices are on-combination. Projecting out of opening 28 is a shift lever 38 for use in changing the combination of the lock as will be described.

Figure 3:
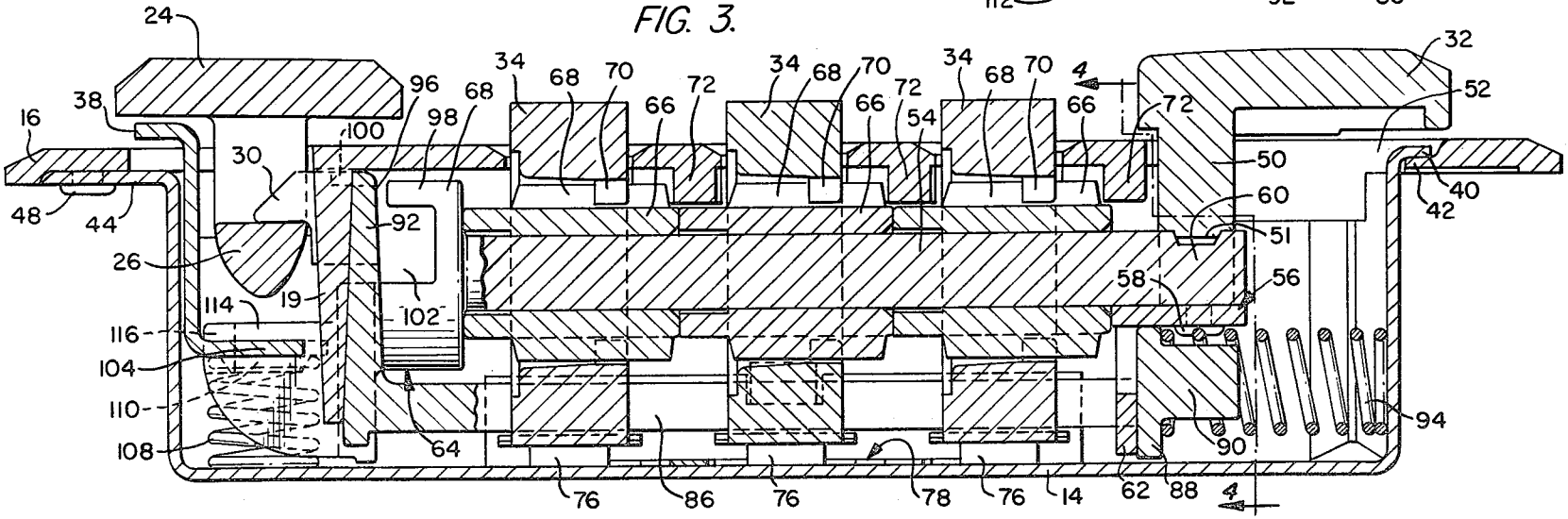
FIG. 3 is a sectional side elevation view of the lock, with the hasp engaged.
Figure 4:
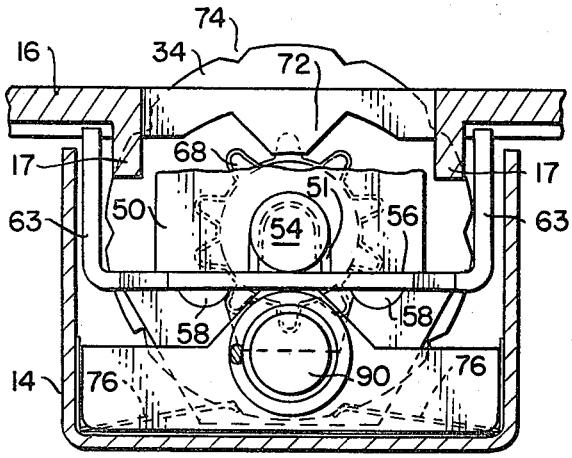
FIG. 4 is a cross sectional view on line 4—4 of FIG. 3.
Figure 5:
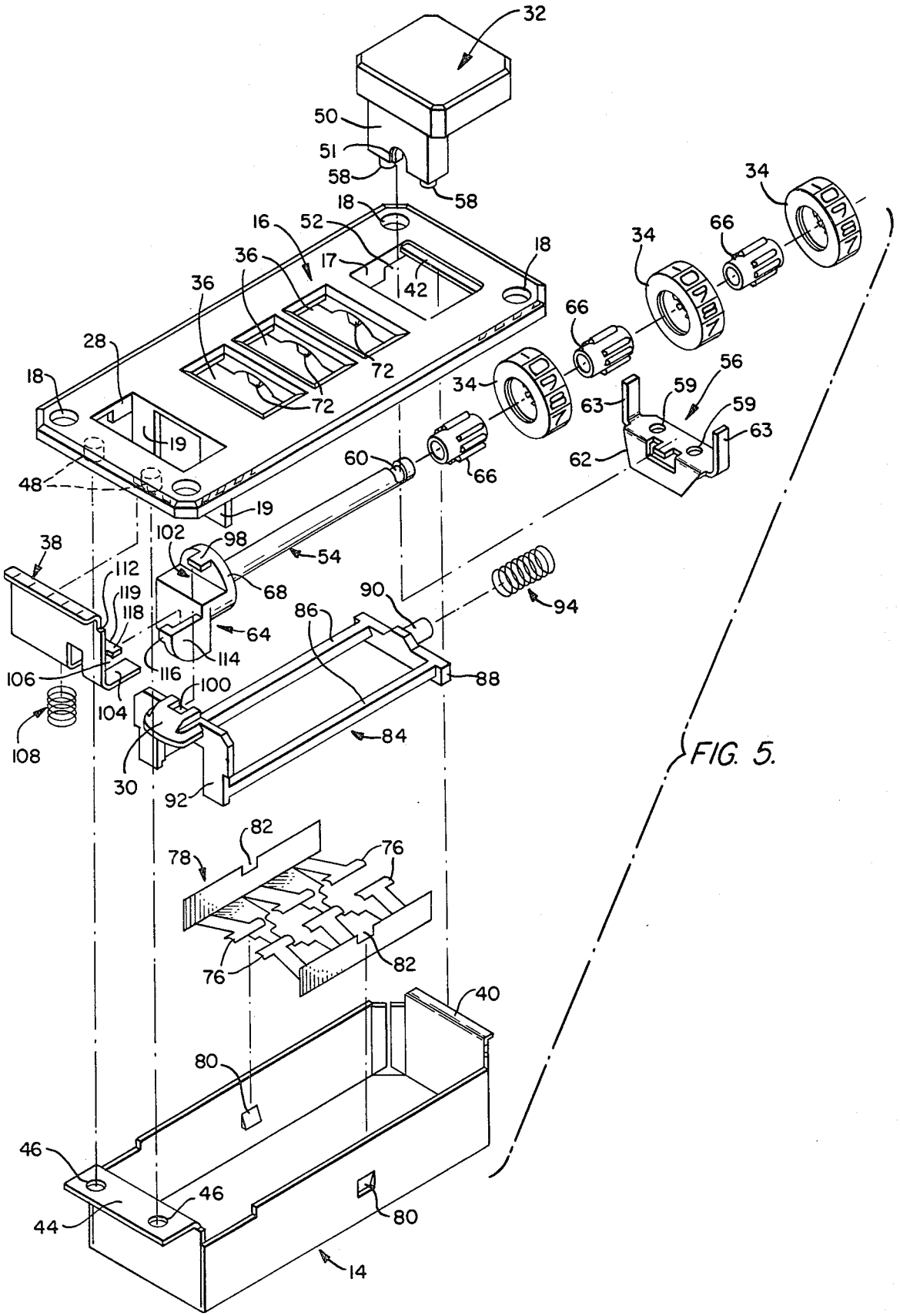
FIG. 5 is an exploded perspective view of the lock components.

As shown for example in FIGS. 3 and 5, casing 14 of the lock is attached to top plate 16 by means of a casing flange 40 engaging a complementary flange 42 on the top plate and, at the opposite end of the lock, the casing has a further flange 44 with openings 46 by which it may be secured to the top plate by rivets 48, or the like. Puller 32 includes a depending yoke 50 extending into the lock casing through an opening 52 in the top plate. Yoke 50 has an internal circumferential ridge 51 and the yoke fits over shaft 54 with the ridge 51 engaging in a reduced diameter shaft section 60. A bracket 56 is provided for securing puller 32 to shaft 54 by means of rivets 58 formed integrally with yoke 50 and fitting in openings 59 in a lateral plate portion of bracket 58. The puller and shaft are thus connected for longitudinal movement in unison and together constitute the manual actuator for moving latch 30. Bracket 56 includes a depending flange 62 and upwardly extending arms 63. Flange 62 supports the rear end of shaft 54 on the base of casing 14 and, as shown in FIG. 4, arms 63 extend upwardly to top plate 16 while fitting outside of internal walls 17 formed integrally with the top plate, so as to laterally and vertically locate the shaft and puller within the lock casing. Support for the forward end of shaft 54 is provided by a head structure 64 integrally formed on the forward end of the shaft.

Figure 6:
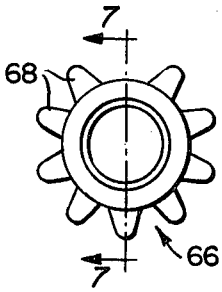
FIG. 6 is an end view of a combination lock sleeve.
Figure 7:
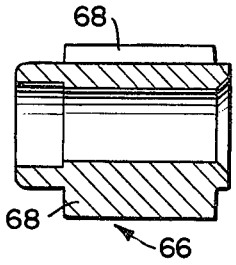
FIG. 7 is a cross sectional view on line 7—7 of FIG. 6.
Figure 8:
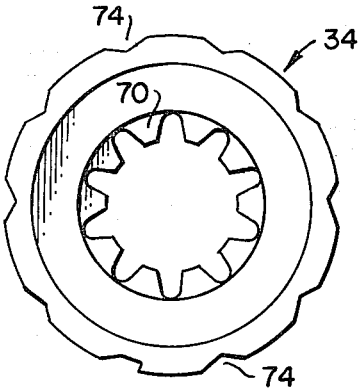
FIG. 8 is an end view of a combination dial.
Figure 9:
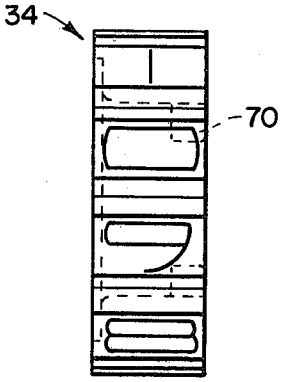
FIG. 9 is a side view of the dial.

Shaft 54 carries abutting combination lock sleeves 66 between a flange portion 68 of head structure 64 and bracket 56. Sleeves 66, see FIGS. 6 and 7, are freely rotatably mounted on shaft 54 and have external teeth which mesh with internal teeth 70 on dials 34 which encircle the respective sleeves. As shown particularly in FIG. 6, one tooth on each of the sleeves 66 is omitted. Adjacent the respective dials, top plate 16 is formed internally with blocking pieces 72 which conform in shape to the space between the sleeve teeth 66 bounding the omitted tooth. Each dial 34 has, in known manner, an external series of combination indicia, with recesses 74 therebetween. These recesses engage the opposed arms 76 of a dial spring 78, see particularly FIG. 5, the dial spring being mounted on the base of casing 14 and being held in place by complementary locating means 80, 82 on the casing and dial spring, respectively.

Latch 30 is preferably formed integrally on the forward end of a slide assembly 84 (see FIG. 5), the slide assembly including spaced longitudinal limbs 86, a cross member 88 at the rear of the assembly and a boss 90 extending rearwardly from the cross member. At its front end, the slide assembly includes an arched portion 92, with latch 30 extending forwardly from the top of the arched portion. The configuration of the slide assembly and its position in casing 14 is such that limbs 86 straddle the lower peripheral portions of dials 34 and cross member 88 sits immediately behind flange 62 of bracket 56 (see FIG. 3). A first coil compression spring 94, located by boss 90, is inserted between the righthand wall of casing 14, as shown in FIG. 3, and cross member 88 so as to urge slide assembly 84 to the left as shown in this figure, towards a position in which arched portion 92 is arrested by limbs 19 dependent from top plate 16. Through abutting engagement of cross member 88 with flange 62 of bracket 56, shaft 54 and puller 32 are thereby also urged to the left. Further, it will be appreciated that when the shaft 54 and puller 32 are drawn to the right from the position shown in FIG. 3, flange 62 abutting against cross member 88 will also draw the slide assembly, and thus latch 30 to the right against the action of spring 94. It will thus be seen that cross member 88 and flange 62 form a floating, resilient-type connection between the slide assembly and latch on the one hand, and the shaft 54 and puller 32 on the other hand, which causes the latch to be drawn to the right in unison with the shaft and puller on movement of the puller in this direction. The connection is such, however, that, in certain circumstances, as will be described, the latch and slide assembly can be urged to the right as shown in FIG. 3, against the action of spring 94, independently of shaft 54 and puller 32. Additionally, due to the floating type connection between the slide assembly and flange 62, the slide assembly is in certain conditions, to be described, free to perform limited downward rocking movement about flange 62.

In the normal or rest position of the lock as shown for example in FIG. 3, spring 94 holds the slide assembly 84 in a position relative to shaft 54 in which a rear face portion 96 of latch 30 aligns for abutting engagement against a blocking protrusion 98 formed on head structure 64 at the front end of shaft 54. Further, when the hasp 26 is engaged, as shown in FIG. 3, the upper surface of the hasp underlies latch 30 and prevents the latch from being tilted downwardly to clear blocking protrusion 98. Accordingly, in this condition of the lock, the slide assembly 84 cannot effectively be urged to the right against spring 94 independently of shaft 54 and puller 32. When, however, the hasp is disengaged, the slide assembly can be rocked downwardly on flange 62, as will be described in more detail hereinafter, allowing blocking protrusion 98 to enter a recess 100 in latch 30 so that the slide assembly can then be urged to the right against spring 94 independently of shaft 54 to a limited extent, with latch 30 moving into an opening 102 in head structure 64.

Figure 2:
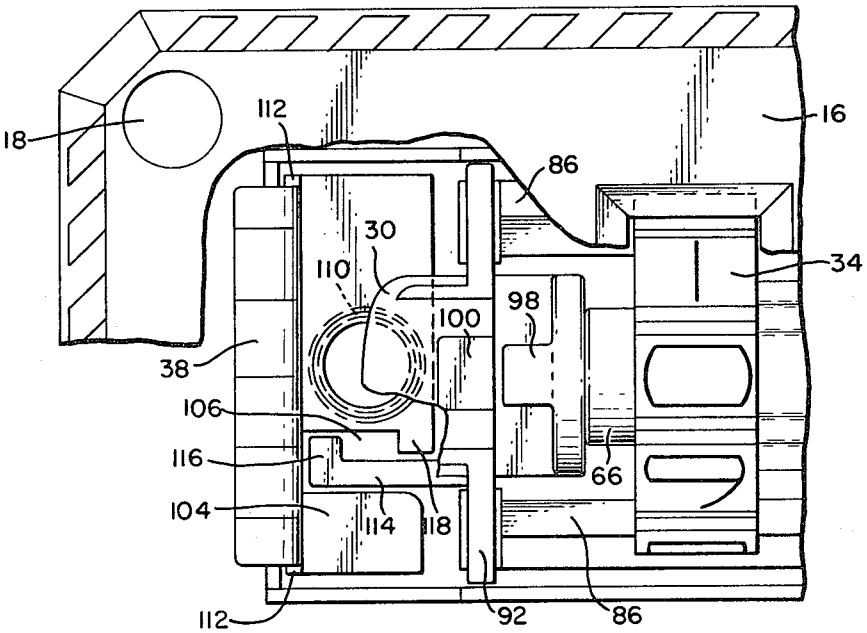
FIG. 2 is a top plan view of a forward end portion of the lock with parts broken away.

The lock also includes a mechanism for changing the combination to one of a user's own particular choice. This mechanism includes the already referred to shift lever 38, the upper end of which protrudes through hasp opening 28 in top plate 16. Lever 38 further includes a base section 104 with a cut-out 106 (see FIG. 2). Lever 38 is urged upwardly by a second coil spring 108 acting between the base of casing 14 and a locating boss 110 on the undersurface of the lever, the lever being located laterally by the side walls of casing 14. Upward movement of lever 38 is limited by lever shoulders 112 which engage under opposite side walls of top plate 16 defining the opening 28. The combination changing mechanism further includes a forwardly projecting extension 114 on the head structure 64 of shaft 54, such extension terminating in a lateral projection 116 located in cut-out 106 of lever 38 (see particularly FIG. 2). When lever 38 is in its normal upper position, its base section 104 is in horizontal alignment with projection 116 and accordingly movement of the shaft and puller to the right, as shown in FIG. 2 is limited by engagement of projection 116 against a shoulder portion 118 of base member 104. Depression of lever 38, however, moves base portion 104 below the level of projection 116, thereby permitting further movement of shaft 54 to the right as will be described.

Figure 10:
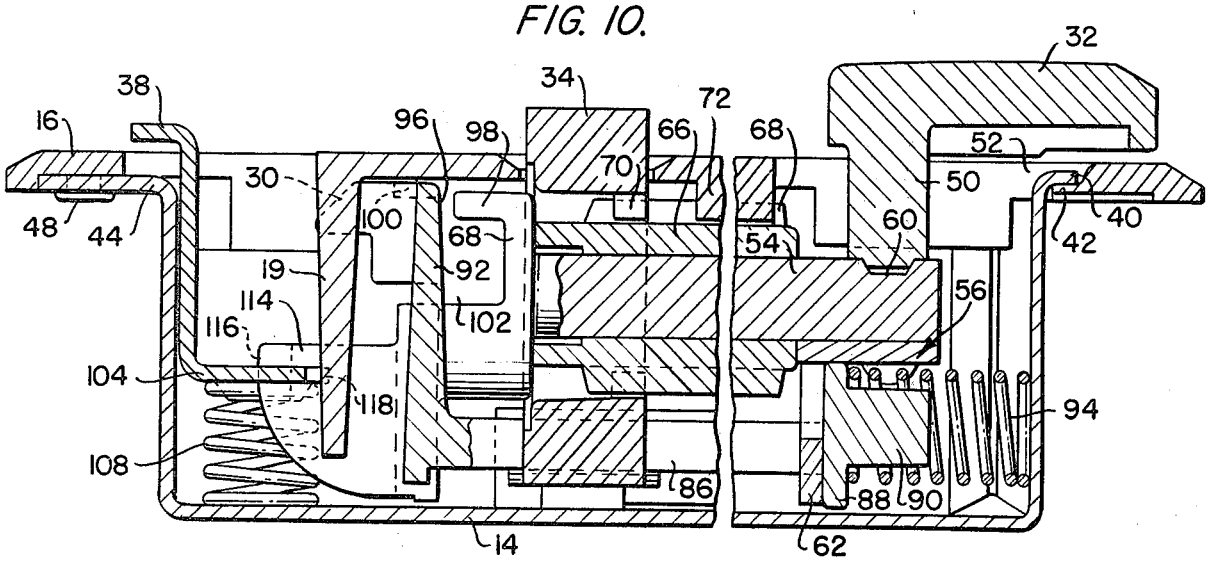
FIG. 10 is a contracted sectional side elevation view of the lock, shown in a hasp-releasing position.

The functioning of the lock as above described is as follows:

With the hasp 26 and latch 30 in engagement, as shown in FIG. 3, if the combination dials 34 are off-combination, at least one of the teeth 68 on sleeves 66 will align with a blocking formation 72 and effectively prevent the shaft and puller from being moved to the right to open the lock. If the dials and sleeves are on-combination, however, then the gaps defining the omitted tooth on each sleeve will align with the respective blocking formations 72 so that the puller 32 and shaft 54 can be moved to the right from the FIG. 3 position. As described earlier, movement of shaft 54 to the right, also draws slide assembly 84 to the right against spring 94 and the lock components are moved to the position shown in FIG. 10, in which latch 30 releases hasp 26 and the hasp assembly springs up to the position shown in FIG. 1. As indicated, movement of the shaft and puller to the right is limited by engagement of protrusion 116 with shoulder portion 118 of lever 38. Accordingly, in the condition of the lock illustrated in FIG. 10, the teeth of the respective sleeves 68 and dials 70 are still in mesh so that the set combination of the lock is maintained. Also, in this position, blocking formations 72 engage in the omitted tooth spaces of the sleeves, thereby preventing the dials and sleeves from being rotated out of the on-combination condition.

Figure 12:
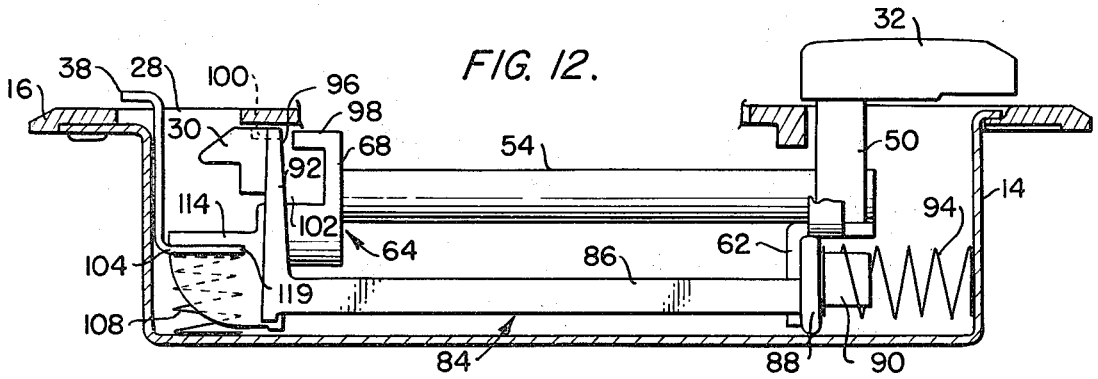
FIGS. 12–14 are somewhat diagrammatic views of components of the lock illustrating the manner in which the hasp is engaged.
Figure 13:
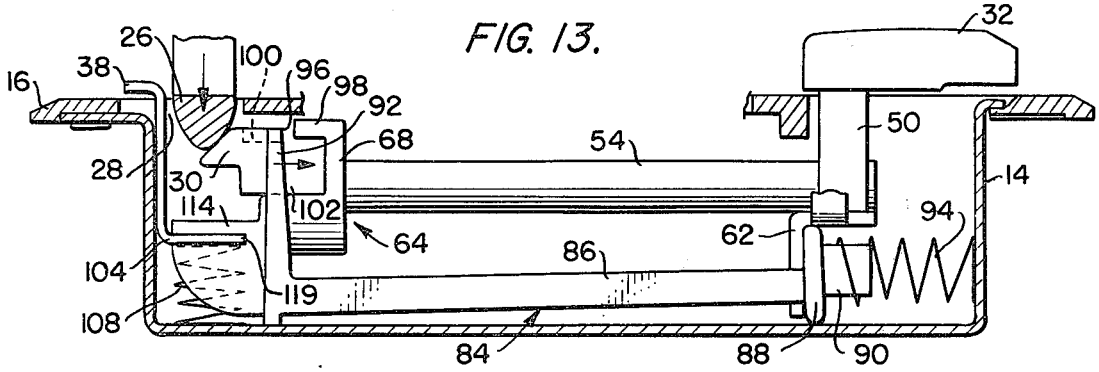
Figure 14:
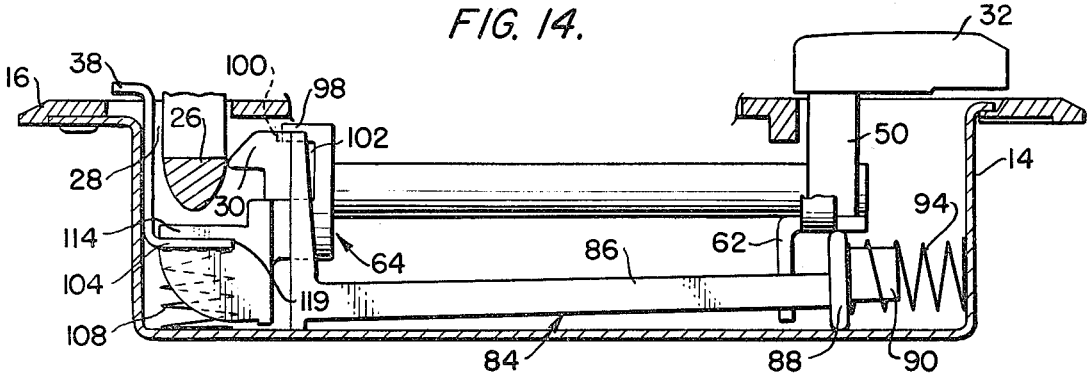

When the lock has been opened, hasp 26 can be pressed back into engagement with latch 30 irrespective of whether the dials and sleeves are in an on-combination or an off-combination setting. This is due to the resilient connection formed between bracket 56 and slide assembly 84 and the sequence of movements is illustrated in FIGS. 12–14. FIG. 12 depicts the mutual positioning of shaft 54 and slide assembly 84 when the lock is open and irrespective of whether the sleeves and dials are on or off-combination. (The sleeves and dials have been omitted in FIGS. 12–14 for clarity.) As shown in FIG. 13, when hasp 26 is pressed into opening 28, it engages the nose portion of latch 30 to produce a camming action which has the effect both of tilting the latch downwardly by rocking movement of slide assembly 84 on the flange 62 and of pressing the slide assembly to the right against spring 94. Downward rocking movement of the slide assembly frees the rear portion 96 of latch 30 from a position in which it would engage blocking protrusion 98 on shaft 54 and allows this protrusion to enter latch recess 100 as described above. Accordingly, the hasp 26 cams latch 30 into the opening 102 of head structure 64, moving slide assembly 84 to the right independently of shaft 54 and allowing the hasp to move down against the front edge of latch 30. When the hasp is pressed fully home, spring 94 snaps the slide assembly 84 and latch 30 back into the position shown in FIG. 3.

It will be seen that in the closed position of the lock illustrated in FIG. 3, even if a suitable tool or bent wire is manipulated under the hasp plate 24, the latch cannot be urged to the right out of hasp-engaging position, because it is supported by the hasp in a position which prevents the surface 96 from being tilted down to clear blocking protrusion 98. Accordingly, the lock combines a facility whereby the hasp can be re-engaged with the latch, even if the lock is off-combination, with a means for effectively preventing the lock from being forced open when the hasp is re-engaged.

Figure 11:
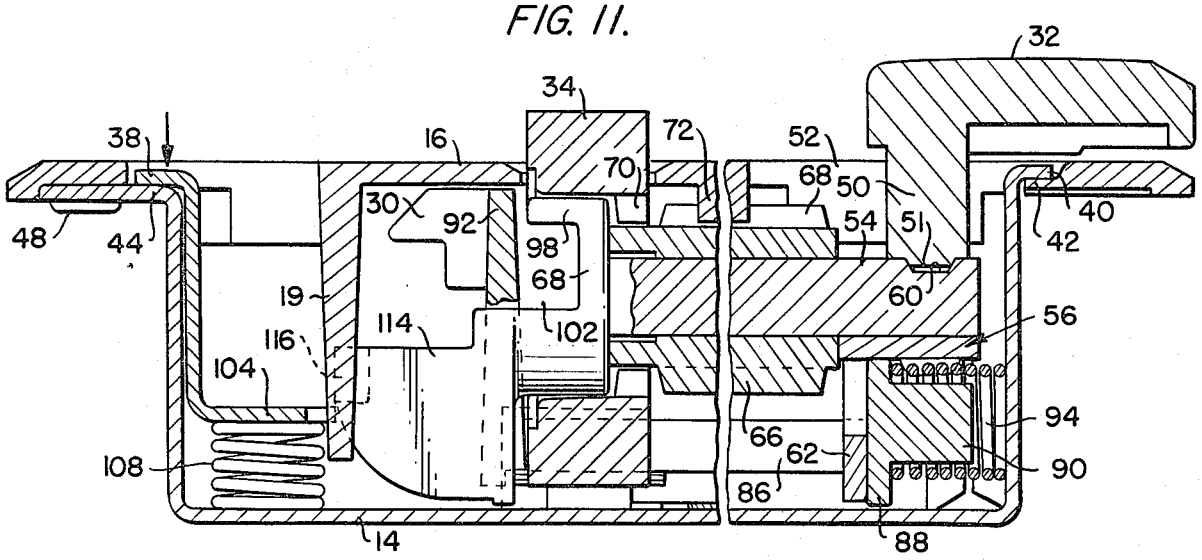
FIG. 11 is a contracted sectional side elevation view of the lock, shown in a combination-changing position.

To change the combination of the lock when the hasp is disengaged and the dials and sleeves are on-combination, shift lever 38 is depressed so that shoulder portion 118 is moved below the level of projection 116. In this position, the puller and shaft 54 can be moved further to the right than the position shown in FIG. 10. Such further movement of the shaft and puller to the right, brings the sleeve teeth 68 out of engagement with their respective dial teeth 70 to allow a combination change, as shown in FIG. 11. If the shift lever 38 is released in this condition it will hold the shaft and puller in a combination changing location by engagement of projection 116 against the free edge 119 of shoulder portion 118. Then, after a combination change, a further depression of shift lever 38 allows spring 94 to snap the shaft and slide assembly back into the positions shown in FIGS. 3 and 12.

While only a single preferred embodiment of the invention has been described herein in detail, it will be appreciated by those skilled in the art that modifications may be made within the scope of the attached claims, and the invention is not limited to the particular features heretofore described. For example, the facility for moving the latch member independently of the actuator when the hasp is disengaged, such independent movement being blocked when the hasp and latch member are in engagement, can be embodied in locks having a form of combination locking system other than the particular puller-actuated, shaft-mounted dial and sleeve system herein described.

We claim:

1. A combination lock including a latch adapted to engage a hasp, actuator means for moving said latch from a hasp-engaging position to a disengaging position only when the lock is on-combination, connection means between said latch and said actuator means for permitting movement of said latch out of said hasp-engaging position independently of said actuator means when said latch is disengaged from a hasp, whereby the hasp may be re-engaged with the latch when the lock is off-combination, and blocking means effectively preventing movement of said latch out of said hasp-engaging position independently of said actuator means when the hasp and latch are in engagement.

2. The lock as defined in claim 1, wherein said connection means includes means normally aligning said latch with said blocking means and means permitting misalignment of said latch and said blocking means to enable said latch to be moved out of said hasp-engaging position independently of said actuator means when the hasp is disengaged, the hasp when in engagement with said latch supporting said latch against misalignment from said blocking means.

3. The lock as defined in claim 2, wherein said aligning means includes biasing means urging said latch into alignment with said blocking means.

4. The lock as defined in claim 1 or claim 2, wherein said blocking means comprises a part of said actuating means.

5. The lock as defined in claim 1, including a casing and wherein said actuator means includes a shaft mounted for longitudinal movement in said casing, said shaft carrying a plurality of combination locking devices for permitting movement of said shaft in a hasp-disengaging direction only when said combination locking devices are on-combination, said lock including a slide assembly in said casing having a forward end portion carrying said latch and wherein said connection means is formed between said slide assembly and said shaft.

6. The lock as defined in claim 5, wherein said connection means includes a bracket means connected with said shaft, a cross member associated with said slide assembly, and means urging said cross member into abutting engagement with said bracket means and urging said latch toward the hasp-engaging position.

7. The lock as defined in claim 6, wherein said blocking means is formed on a forward portion of said shaft and said connection means aligns a rear surface of said latch member with said blocking means.

8. The lock as defined in claim 7, wherein said connection means permits rocking movement of said slide assembly relative to said bracket means to move said latch away from said blocking means when the hasp is disengaged, and the hasp, when engaged, supporting said latch for abutting engagement with said blocking means.

9. The lock as defined in claim 5, including means for moving the shaft to a position allowing the combination of said locking devices to be changed.

10. The lock as defined in claim 9, wherein said moving means includes a shift member protruding from said casing, the lock further including an extension on said shaft adapted to engage said shift member in a manner preventing movement of the shaft to a combination changing position, and means for moving said shift member to disengage said shaft extension thereby permitting movement of said shaft to a combination changing position.

11. A combination lock including a casing, an elongated shaft mounted for longitudinal movement in said casing, a manual actuator connected to said shaft for moving said shaft axially in one direction in said casing, combination locking means comprising a plurality of individually adjustable locking devices for permitting movement of said shaft in said one direction only when said locking means is on-combination, a latch adapted to engage a hasp, said latch being operatively connected with said shaft for movement with said shaft in said one direction when said shaft is moved by said manual actuator, blocking means acting between said shaft and said latch when said latch is in engagement with a hasp for preventing movement of said latch in said one direction independently of said shaft, and means permitting relative movement between said shaft and said latch rendering said blocking means ineffective when said latch is disengaged from a hasp, to allow movement of said latch in said one direction independently of said shaft.

12. The combination lock as defined in claim 11, wherein said shaft includes an extension defining said blocking means and wherein said latch and said shaft have a connection means therebetween permitting rocking movement of said latch relative to said shaft when a hasp is disengaged from said latch member to provide clearance between said latch member and said blocking means permitting movement of said latch in said one direction independently of said shaft.

13. The lock as defined in claim 12, including a bracket means connected with said shaft, a slide assembly connected with said latch and extending substantially parallel with said shaft, said connection means being formed between said bracket means and said slide assembly.

14. The lock as defined in claim 13, wherein said connection means includes complementary lateral surfaces on said slide assembly and said bracket means respectively and spring means urging said surfaces into abutting contact.

15. The lock as defined in claim 11, including combination-changing means comprising an extension on said shaft, and a combination shift member protruding from said casing, said extension engaging said shift member to prevent movement of said shaft to a combination-changing position, and means for moving said shift member out of engagement with said shaft extension when the latch is disengaged from a hasp, to permit movement of said shaft to a combination-changing position.

16. The lock as defined in claim 11, wherein said latch includes a recess adapted to accommodate said blocking means when said latch is moved in said one direction independently of said shaft.

17. The lock as defined in claim 12, wherein said extension defines an opening adjacent said blocking means for receiving said latch when said latch is moved in said one direction independently of said shaft.

18. A combination lock including a shaft-actuator assembly comprising a shaft and an actuator connected to one end of the shaft for manually moving the shaft axially in one direction, the lock further including rotary combination elements disposed in axially adjacent positions on said shaft for permitting actuator-induced movement of the shaft in said one direction only when the elements are set on combination, a slide provided with a hasp-engageable latch, the latch being located adjacent the other end of the shaft, and the slide extending from the latch toward said one end of the shaft, and a connection between the slide and the assembly adjacent said one end of the shaft, the connection providing movement of the slide in conjunction with the assembly responsive to actuator-induced movement of the assembly in said one direction for moving the latch from a hasp-engaging position to a hasp-disengaging position, the connection further allowing hasp-induced movement of the slide in said one direction independently of the assembly when the hasp is disengaged from the latch, whereby the hasp may be re-engaged even when the combination elements are off combination.

19. The lock as defined in claim 18, including blocking means effectively preventing movement of the slide in said one direction independently of the assembly when the hasp and latch are in engagement.

20. The lock as defined in claim 18, wherein said connection includes a bracket connected with the shaft, a cross-member associated with the slide and means urging the cross-member into abutting engagement with the bracket and urging the latch toward the hasp-engaging position.

21. The lock as defined in claim 20, wherein the actuator embraces the shaft and is connected to the bracket.

22. The lock as defined in claim 20, wherein the connection permits rocking movement of the slide relative to the bracket.

23. The lock as defined in claim 18, wherein the combination elements comprise rotary dials each coupled for rotation with a corresponding sleeve mounted on the shaft, and wherein actuator-induced movement of the shaft in said one direction is accompanied by axial movement of the sleeves relative to the dials.

24. The lock as defined in claim 20, wherein the slide includes laterally spaced elongate limbs straddling the combination elements, the limbs connecting the latch to the cross-member.

* * * * *